US011707134B2

(12) United States Patent
Lee

(10) Patent No.: US 11,707,134 B2
(45) Date of Patent: Jul. 25, 2023

(54) PACKABLE CHAIR FOR TRANSPORTING CONTAINERS

(71) Applicant: FIIYA LLC, Bellingham, WA (US)

(72) Inventor: Elijah Lee, Bellingham, WA (US)

(73) Assignee: FIIYA LLC, Bellingham, WA (US)

( * ) Notice: Subject to any disclaimer, the term of this patent is extended or adjusted under 35 U.S.C. 154(b) by 0 days.

(21) Appl. No.: 17/545,871

(22) Filed: Dec. 8, 2021

(65) Prior Publication Data

US 2022/0175140 A1 Jun. 9, 2022

Related U.S. Application Data

(60) Provisional application No. 63/122,755, filed on Dec. 8, 2020.

(51) Int. Cl.

| | |
|---|---|
| ***A47C 4/52*** | (2006.01) |
| ***A47C 13/00*** | (2006.01) |
| ***A47C 1/14*** | (2006.01) |
| ***A47C 1/032*** | (2006.01) |
| ***A47C 7/62*** | (2006.01) |
| ***A47C 7/00*** | (2006.01) |
| ***A47C 4/28*** | (2006.01) |
| *A45F 4/02* | (2006.01) |

(52) U.S. Cl.

CPC ..... *A47C 1/14* (2013.01); *A47C 1/03205* (2013.01); *A47C 4/28* (2013.01); *A47C 7/006* (2013.01); *A47C 7/628* (2018.08); *A45F 2004/026* (2013.01)

(58) Field of Classification Search

CPC ..... A47C 1/14; A47C 4/28

USPC ..... 297/17, 129, 118

See application file for complete search history.

(56) References Cited

U.S. PATENT DOCUMENTS

| | | | | |
|---|---|---|---|---|
| 253,333 A * | 2/1882 | Armstrong | A47C 1/026 297/53 |
| 1,398,253 A * | 11/1921 | Blando | A47C 17/82 297/17 X |
| 1,452,869 A * | 4/1923 | Cattier | A47C 4/14 297/118 |
| 1,842,424 A * | 1/1932 | Ponten | A47C 1/146 297/440.11 |

(Continued)

FOREIGN PATENT DOCUMENTS

| | | | |
|---|---|---|---|
| FR | 2962310 | 1/2012 | |
| WO | WO-2021026226 A1 * | 2/2021 | A47C 1/143 |

*Primary Examiner* — Rodney B White

(74) *Attorney, Agent, or Firm* — Sheridan Ross P.C.

(57) ABSTRACT

A packable chair is provided that is transformable between multiple configurations, including a storage configuration and a chair configuration. In the storage configuration, the portions of the packable chair are arranged and fastened to define an enclosed volume in which containers and other items can be stored. A user can wear the packable chair like a backpack in this storage configuration to transport the contents from, for example, a car to a location on a beach. Then, the contents can be removed from the enclosed volume, and the portions can be rearranged to form the chair configuration where a user can lounge and access the contents of the containers. The chair is also capable of achieving a travel configuration in which the chair can be worn as a backpack for convenient transportation without stowing a user's items.

20 Claims, 7 Drawing Sheets

(56) References Cited

U.S. PATENT DOCUMENTS 1,963,708 A * 6/1934 Marvin ..... A47C 1/146 297/31
2,122,347 A * 6/1938 Lasch ..... A47C 1/14 297/129 X
2,450,783 A * 10/1948 Collins ..... A47C 4/12 297/51
2,547,073 A * 4/1951 Bueler ..... A45F 3/26 297/452.13
3,179,465 A * 4/1965 Roberts ..... A47C 4/52 297/17 X
3,495,868 A * 2/1970 Venderminden ..... A47C 4/28 297/27
3,808,616 A * 5/1974 White ..... A47C 1/146 5/722
3,929,373 A * 12/1975 Gawlinski ..... A47C 1/143 297/29
3,947,903 A * 4/1976 Menke ..... A47C 17/70 297/17 X
4,470,630 A * 9/1984 Shields ..... A47C 1/146 297/118
4,514,009 A * 4/1985 Vanderminden ..... A47C 1/14 297/27
4,530,451 A * 7/1985 Hamilton ..... A47C 4/52 224/155
4,577,901 A * 3/1986 Phillips ..... A47C 5/10 297/17 X
4,645,262 A * 2/1987 Furubotten ..... A47C 13/00 297/129 X
4,654,907 A * 4/1987 Haugaard ..... A45C 3/10 297/17 X
4,659,142 A * 4/1987 Kuchinsky, Jr. ..... B62B 1/12 297/129 X
4,762,339 A * 8/1988 Hoek ..... A47C 1/14 280/820
4,773,708 A * 9/1988 Nastu ..... A47C 7/624 297/17 X
4,889,383 A * 12/1989 Jones ..... A47C 4/52 297/17 X
4,890,882 A * 1/1990 Harrington ..... A47C 4/52 297/17 X
4,925,239 A * 5/1990 Powers ..... A47C 1/146 297/17 X
4,934,719 A * 6/1990 duPont ..... A47C 7/006 297/130 X
5,016,792 A * 5/1991 Jay ..... A45F 4/02 297/129 X
5,042,874 A * 8/1991 Williams ..... A47C 4/52 297/17 X
5,121,961 A * 6/1992 Marshall ..... A47C 7/622 297/17 X
5,139,308 A * 8/1992 Ziman ..... A47C 4/52 297/129 X
5,289,958 A * 3/1994 Jay ..... A45F 4/02 297/129 X
5,301,457 A * 4/1994 Seely ..... A47C 29/006 43/132.1
5,356,197 A * 10/1994 Simic ..... A47C 13/00 297/129 X
5,375,277 A * 12/1994 Carr ..... A61G 1/0225 297/129 X
5,423,592 A * 6/1995 Spurrier ..... A47C 1/143 297/129 X
5,501,505 A * 3/1996 Jablonski ..... A47C 1/143 224/155
5,588,696 A * 12/1996 Jay ..... A47C 1/0265 297/129 X
5,785,427 A * 7/1998 Godshaw ..... A47C 13/00 297/118
5,882,079 A * 3/1999 Yang ..... A47C 20/027 5/419
6,003,915 A 12/1999 Bierman
6,099,020 A * 8/2000 Liao ..... B62B 5/085 297/129 X
6,174,585 B1 * 1/2001 Miles ..... A47C 13/00 297/129 X
6,250,712 B1 * 6/2001 Livington ..... A47C 1/146 297/129 X
6,312,048 B1 * 11/2001 Kilmer ..... A47C 13/00 297/129
6,523,894 B1 * 2/2003 Mellace ..... A47C 1/14 297/183.5
6,557,867 B1 * 5/2003 Angstadt ..... B62B 1/12 297/118 X
6,679,556 B1 * 1/2004 Alvestad ..... A47C 20/08 297/354.13
6,789,809 B2 * 9/2004 Lin ..... B62B 5/085 297/129 X
6,796,605 B1 * 9/2004 Chu ..... A47C 4/18 297/29
7,147,277 B1 * 12/2006 Miller ..... A47C 1/143 297/19
7,325,875 B1 * 2/2008 Guerrini ..... A47C 4/52 297/344.21
8,002,349 B1 * 8/2011 Pizzuto ..... A47C 1/143 297/188.05
8,449,026 B1 * 5/2013 Gutierrez ..... A47C 4/28 297/53
8,465,091 B2 * 6/2013 Su ..... A47C 13/00 297/118 X
8,567,860 B2 10/2013 Jue
8,740,298 B2 * 6/2014 Kenttamaa-Squires ..... A47C 7/006 297/118
8,794,699 B1 * 8/2014 Rudolfo ..... A47C 4/20 297/118
8,814,181 B1 * 8/2014 Weldon ..... B62B 3/10 297/129 X
9,271,576 B2 * 3/2016 Loney ..... A47C 1/146
10,154,732 B2 * 12/2018 O'Neill ..... A47C 17/70
10,238,214 B1 * 3/2019 Haythornthwaite ..... A45F 4/02
10,357,098 B2 * 7/2019 Grace ..... A47C 4/52
11,330,907 B1 * 5/2022 Frisch ..... A47C 3/04
2014/0001736 A1 * 1/2014 Daly ..... A47C 1/14 280/657
2015/0366357 A1 * 12/2015 Nelson ..... A47C 1/14 297/129 X
2016/0000228 A1 * 1/2016 Restrepo ..... A45C 11/20 297/188.1
2020/0107642 A1 * 4/2020 Weldon ..... A47C 13/00
2021/0379498 A1 * 12/2021 Sampaio ..... A63F 13/245
2022/0202187 A1 * 6/2022 Rangel ..... A61G 15/002

* cited by examiner

PACKABLE CHAIR FOR TRANSPORTING CONTAINERS

CROSS REFERENCE TO RELATED APPLICATIONS

This application claims priority under 35 U.S.C. § 119(e) to U.S. Provisional Patent Application Ser. No. 63/122,755, filed Dec. 8, 2020, which is incorporated herein by reference in its entirety.

FIELD

The present disclosure relates to packable chairs and specifically to packable chairs that transform between a chair configuration and a storage configuration to transport one or more containers.

BACKGROUND

Packable chairs are useful for transporting a chair to a variety of locations such as concerts, parties, campsites, beaches, etc. The packable chair can be folded or collapsed into a reduced size and then easily transported to the location in a vehicle or carried by a person. Once at the location, the packable chair can be unfolded or unpacked into a chair that can then be used for seating and holding beverages.

Attending a concert, a party, a campsite, a beach, etc. typically includes not only a packable chair but many other items such as beverages for a concert or party, supplies for a campsite, and towels and umbrellas for a beach. Moreover, attendance usually includes parking a vehicle away from the exact location of the concert or beach, and a person makes multiple trips to transport the packable chair and other items to the location of the concert or beach. Further still, a person needs to bring additional items such as a backpack or a towing solution for a cooler. These multiple trips are obviously an additional effort that must be expended on the part of the person, and the additional items are an added cost. Thus, there is a long felt but unmet need to simplify and improve the trip and transportation process between, for instance, a vehicle and the final location of the concert or beach.

SUMMARY

The above shortcomings and other needs are addressed by the various embodiments and configurations of the present disclosure. It is an objective of the present disclosure to provide a packable chair that is transformable between at least two configurations: a first chair configuration and a second storage configuration where items can be stored and transported within the chair between, for instance, a vehicle and the final location of the concert or beach.

It is an aspect of embodiments of the present disclosure to provide a packable chair with multiple portions that serve as both a part of a chair in the chair configuration and a part defining a storage volume in the storage configuration. In one embodiment, the chair has four portions: a back portion, a seat portion, a head rest portion, and a leg rest portion. At least two of these portions are movable to transform the packable chair between configurations. For instance, the head rest portion and leg rest portions move and selectively connect to each other to define an enclosed volume in which containers and other items can be stored.

In some embodiments, the hinges or joints between portions are lockable in preset positions that enable the chair to be set in different positions. These hinges allow a user to quickly and conveniently change the chair from the chair configuration to the storage configuration. In other embodiments, the portions are rotatable relative to each other but a friction or interference force must first be overcome to initiate the rotation. This force is selected such that the portions will not readily move once in the chair configuration or storage configuration but is still small enough that most people can physically overcome the force and move the portions relative to each other.

It is another aspect of embodiments of the present disclosure to provide a packable chair with a plurality of containers that can be stored in the enclosed volume defined by the packable chair in a storage configuration. The containers can store items and supplies that would otherwise need to be individually carried or transported to an event location like a beach or campsite. The containers can include features that promote the transportation of items. For example, the containers can be stackable where a feature on a bottom side of one container can match a feature on a top side of an adjacent container to help prevent relative movement of the containers during transportation. In one embodiment, a protrusion on the bottom side of a container extends into a recess in the top side of an adjacent container. Further still, a container that requires power for heating or cooling the environment within the container can selectively connect to a cable or plug that draws power from a battery and/or a solar panel on the head rest portion.

Next, it is an aspect of embodiments of the present disclosure to provide a packable chair with features that further promote the transportation of contents within an enclosed volume of the packable chair in the storage configuration. The sides of the volume can be defined by panels that can be attached to the back and leg rest portions. These panels can be formed from fabric sheets that attach through Velcro or hook and loop fabric. In some embodiments the panels are attached to a portion of the chair and rolled into a stored configuration. Further still, additional portions can be included that rotate relative to another portion from one position where the additional portions define the left and right sides of the enclosed volume, and then to another position where the additional portions do not obstruct a user in the chair configuration.

In some embodiments, the seat portion contains a second seat hinge that separates the seat portion into first and second seat portions. In these embodiments, the storage configuration can be achieved through aligning the back portion and first seat portion such that they are approximately parallel, and the head rest positioned closer to the second seat hinge than the foot or wheel. The second seat portion is rotated such that it is at an approximately 90 degree angle with the first seat hinge and extends away from the back portion. The leg rest portion is rotated such that it is approximately 90 degrees with the second seat portion and is approximately parallel to the back portion and first seat portion. The head rest can be rotated outwards such that it can be connected to the end of the leg rest portion. In some embodiments, the kick stand is folded such that it is approximately parallel with the back portion. Straps can then be attached to the kick stand and the back portion such that a user can wear the chair while it is in the storage position.

In a further embodiment, the leg of the chair ends in a wheel. When in the storage configuration, as stated above a user can wear the chair as a backpack. Alternatively, a user can hold a handle located on the distal end of the kickstand and roll the chair while in the storage configuration. This allows for easy transportation when heavy articles, such as a cooler, are stored in the enclosed volume.

In various embodiments, the packable chair can transform into a third configuration. In this configuration, the packable chair is transported between locations without transporting containers or otherwise needing to utilize the enclosed volume. The head rest portion can be allowed to simply fold flat against the back portion for transportation in this third configuration. The seat portion is rotated upwards against the back portion and then secured in place. In one embodiment, a fastener is used to secure the seat portion in this position. For example, a loop or lashing can tie one side of the seat portion to the back portion. Then, with the seat portion secured, the leg rest can be allowed to simply fold flat against the seat portion. With this third configuration, the packable chair can be transported from location to location and deployed as a chair without transporting any containers. In some embodiments, this third configuration can include a small storage compartment formed by the side panels. In these embodiments, the small storage compartment may be sized to store items such as a jacket or water bottle.

In further embodiments, the seat portion can include a second seat hinge. In these embodiments, the seat portion is split into two sections, a first, proximal seat section and a second, distal seat section. The first seat section is connected to the back portion by the chair hinge. Further, in some embodiments, the first seat portion extends beyond the seat hinge and ends with a foot or wheel. The second seat section is connected to the leg rest portion by a leg rest hinge. The first and second seat sections are rotatably connected by the second seat hinge. In these embodiments, the third travel configuration is formed by rotating the kick stand such that it is approximately parallel to the back portion. The first seat portion is aligned with the back portion such that the head rest is closer to the second seat hinge than the first seat hinge. The second seat portion is rotated to be approximately parallel to the first seat portion but extend away from the head rest. The leg rest is aligned approximately parallel to the back portion and extends towards the head rest. A user is then able to hold the handle end of the kick stand and, in embodiments containing a wheel at the end of the first seat portion, is able to roll the seat to a desired location. In some embodiments the user may also attach shoulder straps to the kickstand and back portions to wear the chair as a backpack.

In various embodiments, the packable chair can include wheels to help tow or otherwise transport the packable chair. For instance, the wheels are connected to a hinge or any of the portions. A user can grasp the upper end of the packable chair or a handle extending from the upper end of the packable chair and then tow the chair while the chair is in the storage configuration. Once at the final location, the chair can transform into another configuration.

In embodiments of the disclosure, the packable chair has features that help a user carry the packable chair in the storage configuration. Shoulder straps can be connected to a kickstand or other portions of the packable chair to help a user bear the weight of the chair and the containers or other items stored within the chair. In some embodiments, a waist belt is also connected to the kickstand or other portions of the chair to help a user bear even more weight.

One embodiment of the present disclosure is a method for transforming a packable chair from a storage configuration to a chair configuration comprising (i) providing a packable chair having a seat portion connected a back portion, a head rest portion rotatably connected to a distal end of the back portion and a leg rest portion rotatably connected to a distal end of the seat portion, wherein the head rest portion and the leg rest portion are selectively joined in the storage configuration to define an enclosed volume between the portions, and one or more containers are positioned in the enclosed volume, (ii) rotating a kickstand away from the back portion such that the kickstand is at least partially between the back portion and a ground surface, and (iii) separating the head rest portion and the leg rest portion from each other such that the leg rest portion is below the distal end of the seat portion.

One particular embodiment of the present disclosure is a packable chair transformable between a storage configuration and a chair configuration, comprising a back portion connected to a seat portion, wherein a length of the seat portion is less than a length of the back portion; a head rest portion connected to a distal end of the back portion such that the head rest portion is rotatable relative to the back portion, wherein a length of the head rest portion is substantially the same as the length as at least a section of the seat portion; a leg rest portion connected to a distal end of the seat portion such that the leg rest portion is rotatable relative to the seat portion, wherein a length of the leg rest portion is substantially the same as the length of the back portion minus the length of a section of the seat portion; a kickstand connected to the back portion and positioned proximate to an outer surface of the back portion such that the kickstand is rotatable relative to the back portion to change an orientation of the back portion relative to a ground surface, wherein the kickstand comprises at least one strap for a user to carry the packable chair; wherein, in the storage configuration, a distal end of the head rest portion and a distal end of the leg rest portion are selectively connected together such that inner surfaces of the head rest portion, the back portion, the seat portion, and the leg rest portion form an enclosed volume to store a container; and wherein, in the chair configuration, the distal ends of the head rest portion and the leg rest portion are separated and the kickstand portion forms a nonzero angle with the back portion.

In some embodiments, the at least one strap is two adjustable shoulder straps oriented vertically such that a user can wear the straps and the packable chair as a backpack. In various embodiments, the enclosed volume has a rectangular prism shape. In various embodiments, the back portion and the seat portion are connected to each other with a seat hinge, and a wheel extends outward from the seat hinge to support the packable chair on the ground surface in the chair configuration.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and claims themselves.

BRIEF DESCRIPTION OF THE DRAWINGS

The accompanying drawings, which are incorporated in and constitute a part of the specification, illustrate embodiments of the disclosure and together with the Summary given above and the Detailed Description of the drawings given below, serve to explain the principles of these embodiments. In certain instances, details that are not necessary for an understanding of the disclosure or that render other details difficult to perceive may have been omitted. It should be understood, of course, that the disclosure is not necessarily limited to the particular embodiments illustrated herein. Additionally, it should be understood that the drawings are not necessarily to scale.

and

Figure 7:
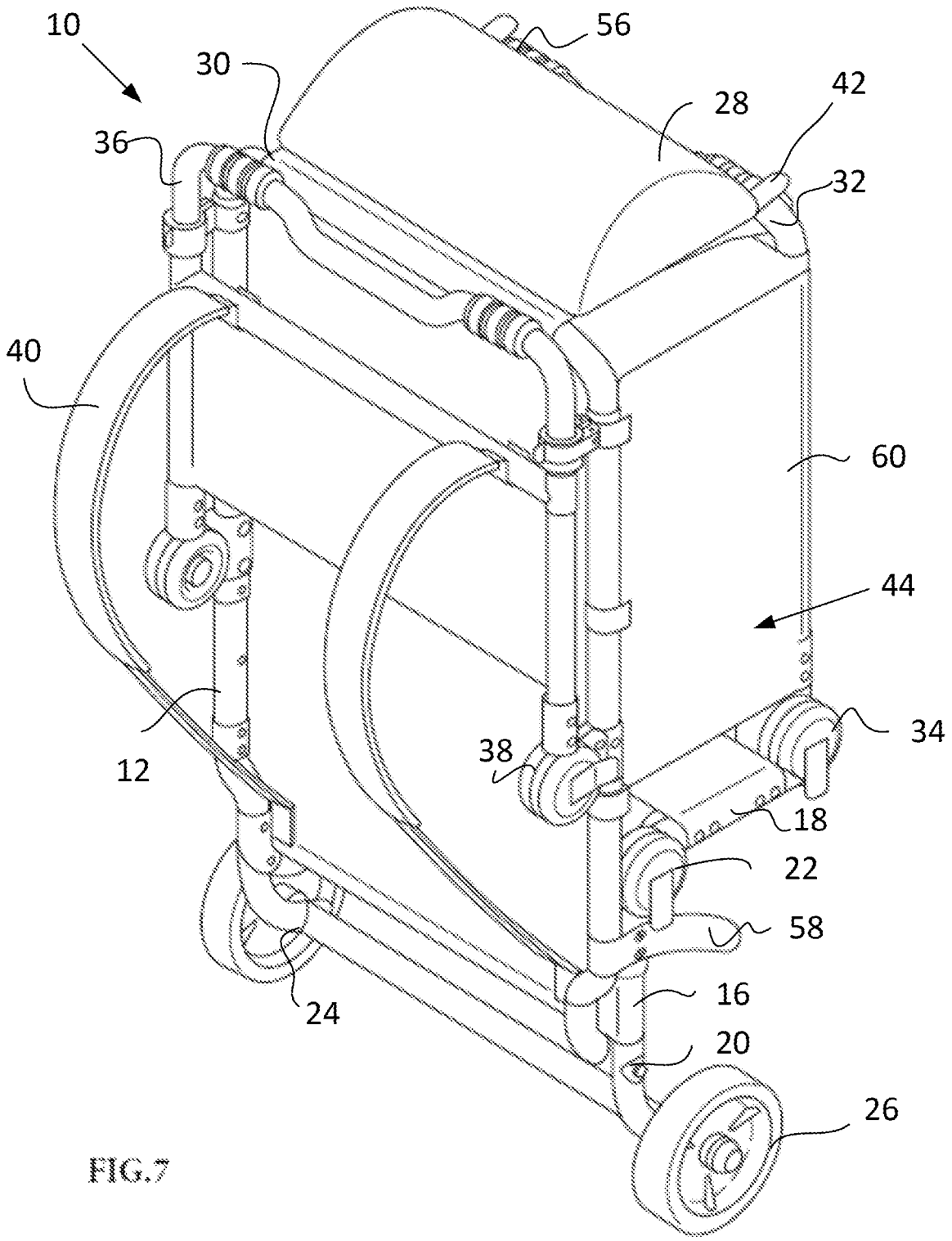

FIG. 7 is a perspective view of a packable chair in a storage configuration according to an embodiment of the present disclosure.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Packable Chair |
| 12 | Back Portion |
| 14 | Seat Portion |
| 16 | First Seat Portion |
| 18 | Second Seat Portion |
| 20 | Seat Hinge |
| 22 | Second Seat Hinge |
| 24 | Hinge Foot |
| 26 | Wheel |
| 28 | Head Rest Portion |
| 30 | Head Rest Connection |
| 32 | Leg Rest |
| 34 | Leg Rest Hinge |
| 36 | Kickstand |
| 38 | Kickstand Hinge |
| 40 | Shoulder Strap |
| 42 | Fastener |
| 44 | Enclosed Volume |
| 46 | Selectively Locking Hinge |
| 48 | First Hinge Member |
| 50 | Second Hinge Member |
| 52 | Locking Tab |
| 54 | Protrusion |
| 56 | Handle |
| 58 | Strap |
| 60 | Fabric Side |
| 62 | Friction Connector |
| 64 | Sleeve |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present disclosure are described herein and as depicted in the drawings. It is expressly understood that although the figures depict packable chairs, and methods and systems for using the same, the present disclosure is not limited to these embodiments.

Figure 1:
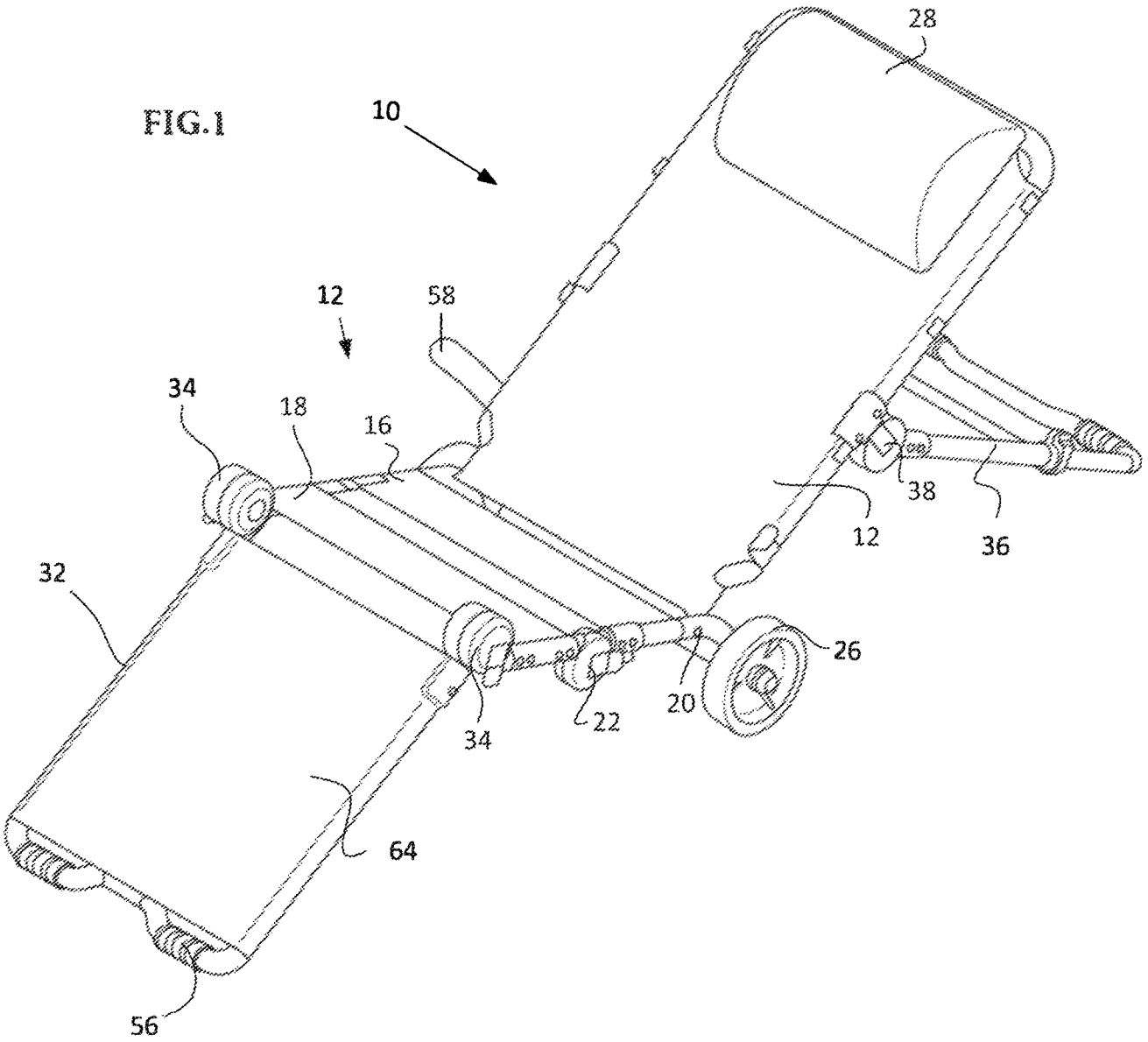
FIG. 1 is a perspective view of a packable chair in a chair configuration according to an embodiment of the present disclosure.
Figure 2:
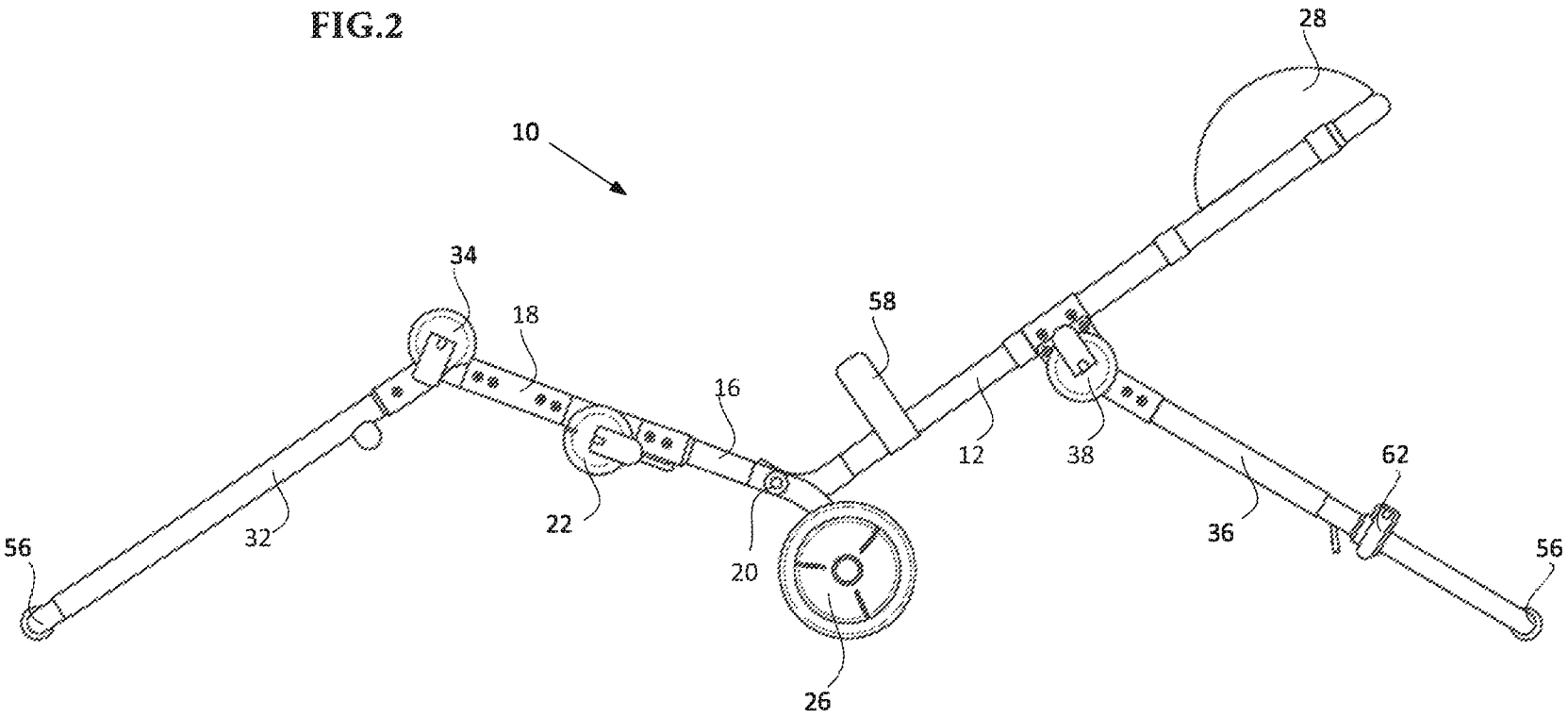
FIG. 2 is a side view of a packable chair in the configuration shown in FIG. 1.

Referring now to FIGS. 1 and 2, a perspective view and a side view of a packable chair 10 in a chair configuration are provided, respectively. Generally, the chair 10 comprises multiple portions or sections that can move to transform the chair 10 between the chair configuration, a travel configuration, and a storage configuration. A back portion 12 and a seat portion 14 are joined together, in the depicted embodiment, at a seat hinge 20 such that the back portion 12 and the seat portion 14 are rotatable relative to each other. It will be appreciated that in some embodiments, the back portion 12 and the seat portion 14 are fixed relative to each other, for example, at a 90 degree angle.

The hinges 46 described herein can allow for free rotation of the adjoining portions. In other embodiments, a hinge 46 can ratchet in one rotational direction until released. In still other embodiments, the hinge 46 can be locked to secure it in a desired position. Further still, a hinge 46 can adjust the angle between adjoining portions and then be locked in place by a pin, clip, etc.

A head rest 28 is connected to the distal end of the back portion 12. The depicted embodiment of the head rest 28 comprises a cushion and a connection feature 30. In the depicted embodiment, the connection feature 30 is a closed strap that loops around a distal cross bar of the back portion 12. In some embodiments the head rest 28 contains a fastener opposite the connection feature 30. The fastener can be used to secure the head rest to a second portion of the chair when the chair is in the storage configuration.

In some embodiments, the seat portion 14 contains a second seat hinge 22 that separates the seat portion into a first, proximal seat portion 16 and a second, distal seat portion 18. In these embodiments, the second seat portion 18 can be folded to create a vertical seat stand that supports the proximal seat portion 16 and provides distance between the ground and the second seat hinge 22.

A leg rest portion 32 is connected to a distal end of the second seat portion 18 at a leg rest hinge 34. The leg rest portion 32 can have a length that is substantially or approximately equal to a length of the back portion 12. In some embodiments, the leg rest portion 32 has a length that is approximately equal to a length of the back portion 12 minus a length of the first or second seat portion 16, 18. With the leg rest 32 substantially equal in length to the back portion 12 minus a length of the first or second seat portions 16, 18 and the head rest and second seat portions 28, 18 substantially equal in length, the shape of the packable chair 10 in FIG. 7 is rectangular when viewed from the side and defines a volume 44 with a rectangular prism shape. The leg rest 32 along with the other portions 12, 18, and 28 are each defined at a perimeter with a rigid material such as metal or high-density plastic. Then, a more elastic material defines the area within the rigid materials to provide comfort to a user lounging in the chair 10. In one embodiment, the rigid material is an aluminum frame made from 1" tubular aluminum. A fabric material can be formed to have a sleeve into which the frame passes to join the rigid frame and the fabric material.

While four portions 12, 18, 28, 32 are depicted as defining the volume in the storage configuration, it will be appreciated that a fewer or greater number of portions can define the volume. For example, the packable chair 10 can have additional portions that rotate relative to one of the portions 12, 18, 28, 32 to define the left and/or right sides of the volume. Moreover, the back portion 12 and the head rest can be combined into a single portion, or the back portion 12 and the seat portion 14 can be combined into a single portion. In further embodiments, the seat portion 14 can be split into two separate sections 16, 18 separated by a second seat hinge 22. In various embodiments, the volume 44 is not a rectangular prism but another shape. For instance, the portions can be curved and form a volume with an ovoid shape.

In some embodiments, a sleeve 64 can be used to cover portions of the chair 10. This sleeve 64 can span a gap between portions and provide a support for a user's body when sitting in the chair. The sleeve 64 can also provide a panel for securing the contents of the volume 44 when in the storage configuration shown in FIG. 7.

FIG. 1 also shows a kickstand 36 that is rotatably connected to the back portion 12 via a hinge 38. Specifically, the kickstand 36 is positioned on an outer surface of the back portion 12, or, stated differently, the kickstand 36 extends away from the outer surface of the back portion 12. The kickstand 36 forms a nonzero angle with the back portion 12 to support the back portion 12 and the rest of the chair 10 in the chair configuration depicted in FIG. 1. The kickstand hinge 38 can hold the kickstand 36 in different positions with a friction or interference fit where the kickstand 36 can be moved about the kickstand hinge 38 with a predetermined force. In some embodiments, the predetermined force is set to be high enough to hold the kickstand 36 in place but low enough that most users can overcome the predetermined force to move the kickstand 36 between positions and configurations.

The kickstand 36 can be adjustable in length where one portion telescopes relative to another portion. In the embodiment shown in the figures, the telescoping members are locked in place using a friction-based connector 62 that prevents the members from moving relative to each other. In other embodiments, bias detents in one portion can selectively engage apertures or recesses in another portion to establish the length of the kickstand 36. An exemplary telescoping detent system is shown in U.S. Pat. No. 6,003,915, the entire disclosure of which is hereby incorporated by reference in its entirety. A shoulder strap 40 such as a backpack strap is connected to the kickstand 36 so that a user can wear the packable chair 10 like a backpack when the chair 10 is in the storage configuration depicted in FIG. 7. It will be appreciated that some embodiments can include, for example, a waist belt to bear a portion of the weight of the packable chair 10 when a user dons the chair 10 like a backpack.

Figure 3:
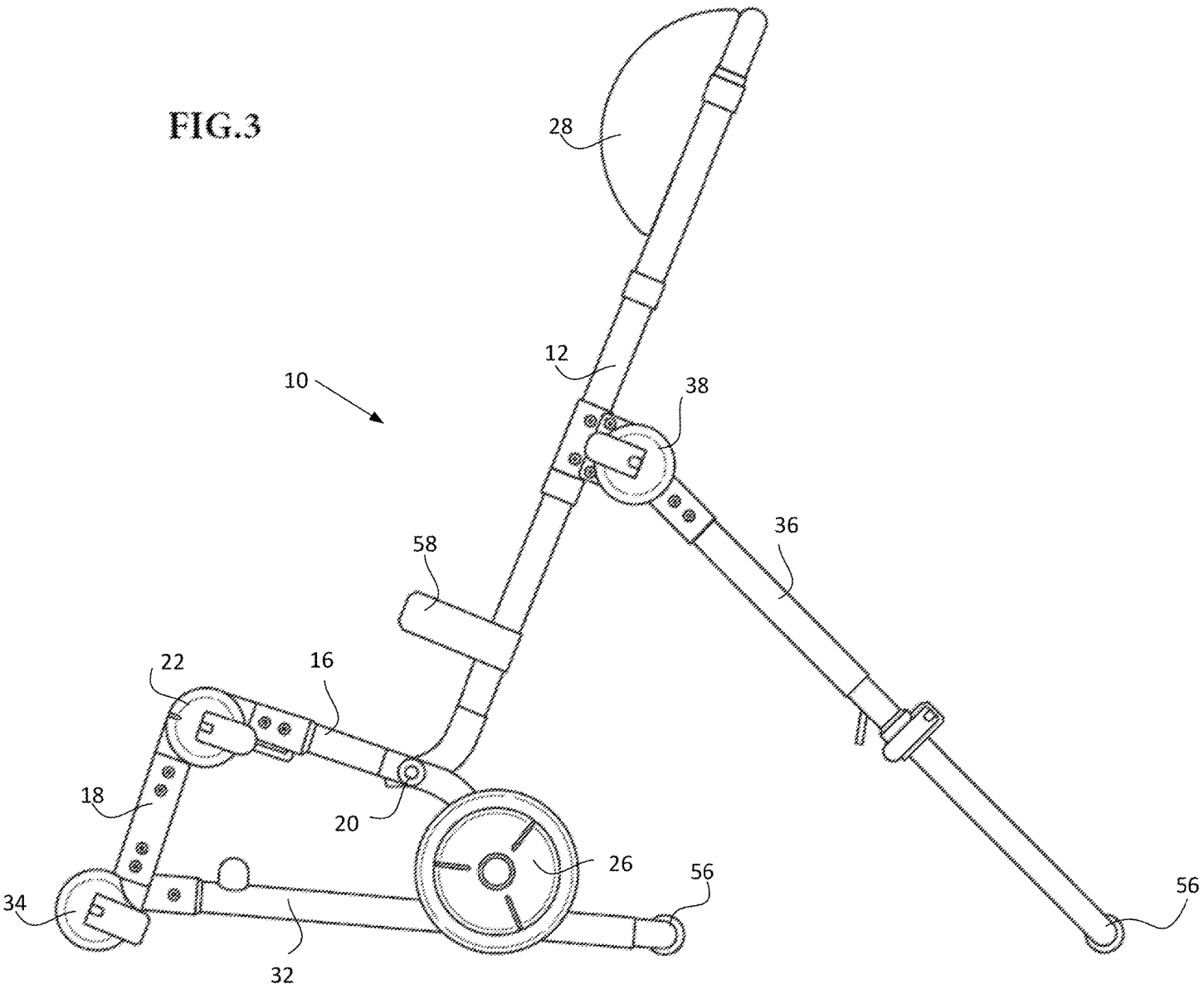
FIG. 3 is a side view of the packable chair in a chair configuration according to an embodiment of the present disclosure.

Referring now to FIG. 3, a side view of the packable chair 10 in a further seat configuration is provided. In this configuration, the back portion 12 and the first seat portion 16 form a right angle with each other. The second seat portion 18 forms a right angle with first seat portion 16 such that the second seat portion 18 is approximately parallel with the back portion 12 and extends away from the head rest 28. The leg rest 32 is folded such that it forms an acute angle with the second seat portion 18 and extends underneath the first seat portion 16. The kickstand 36 is extended to contact the ground and provide support for the back portion 12.

Figure 4:
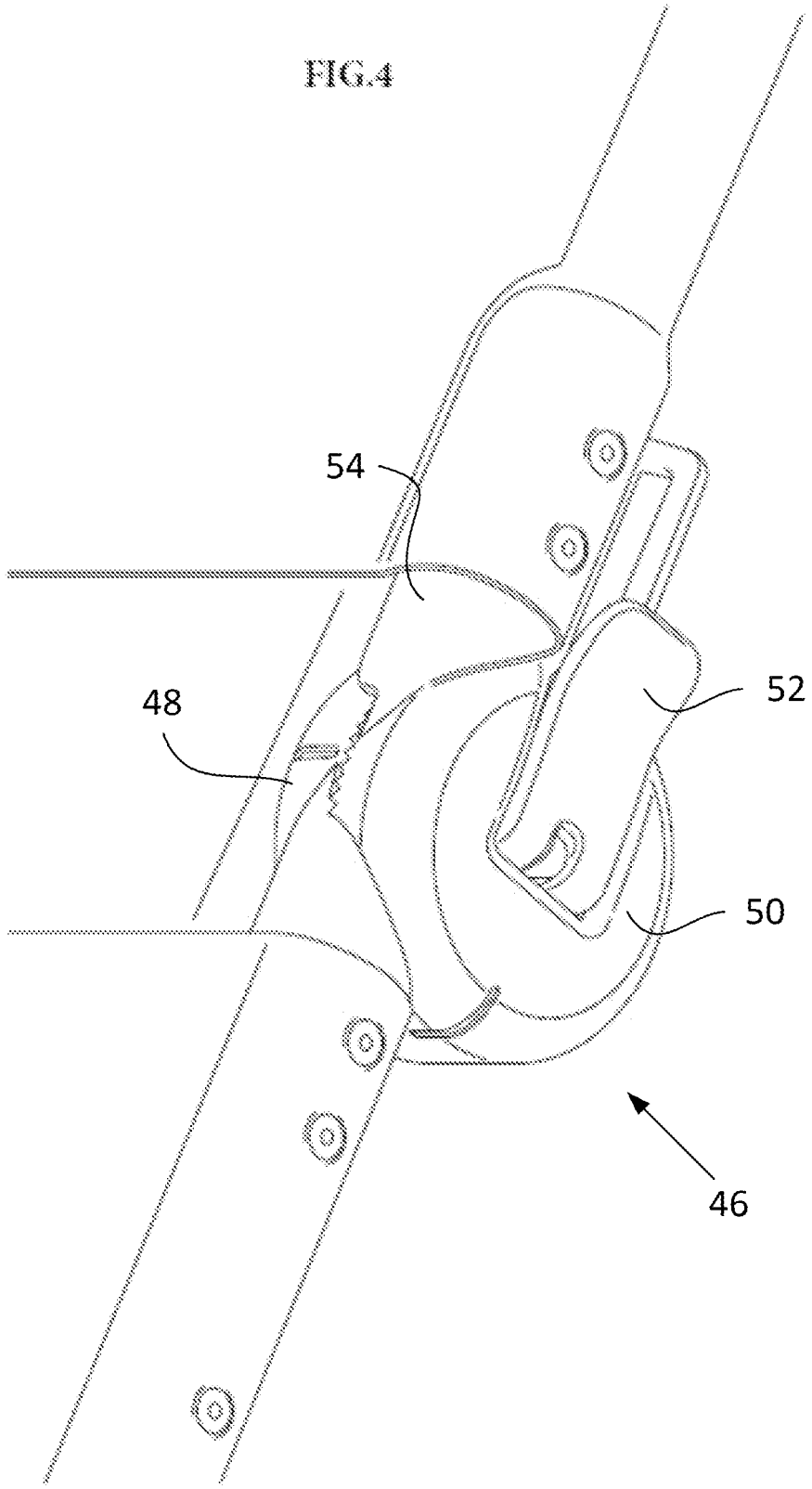
FIG. 4 is a perspective view of a locking hinge according to an embodiment of the present disclosure.

FIG. 4 depicts an embodiment of the selectively locking hinge 46. As shown, the hinge 46 comprises two members 48, 50 having meshed teeth. The two member are rotationally secured by the locking tab 52. When the tab 52 is in the locking position, the teeth are secured to the teeth of the opposite member such that hinge cannot be rotated. When the tab 52 is disengaged, the two members 48, 50 are allowed to be moved apart such that the teeth of the members do not engage.

In the embodiment of the hinge 46 depicted in FIG. 4, the hinge members 48, 50 are generally circular with protrusions 54 extending tangentially from the hinge to connect the chair sections. This tangential connection allows the portions of the chair that are connected to the hinge to be rotated by up to 180 degrees without interference from the opposing section, as shown by the second seat hinge 22 in FIG. 5.

Figure 5:
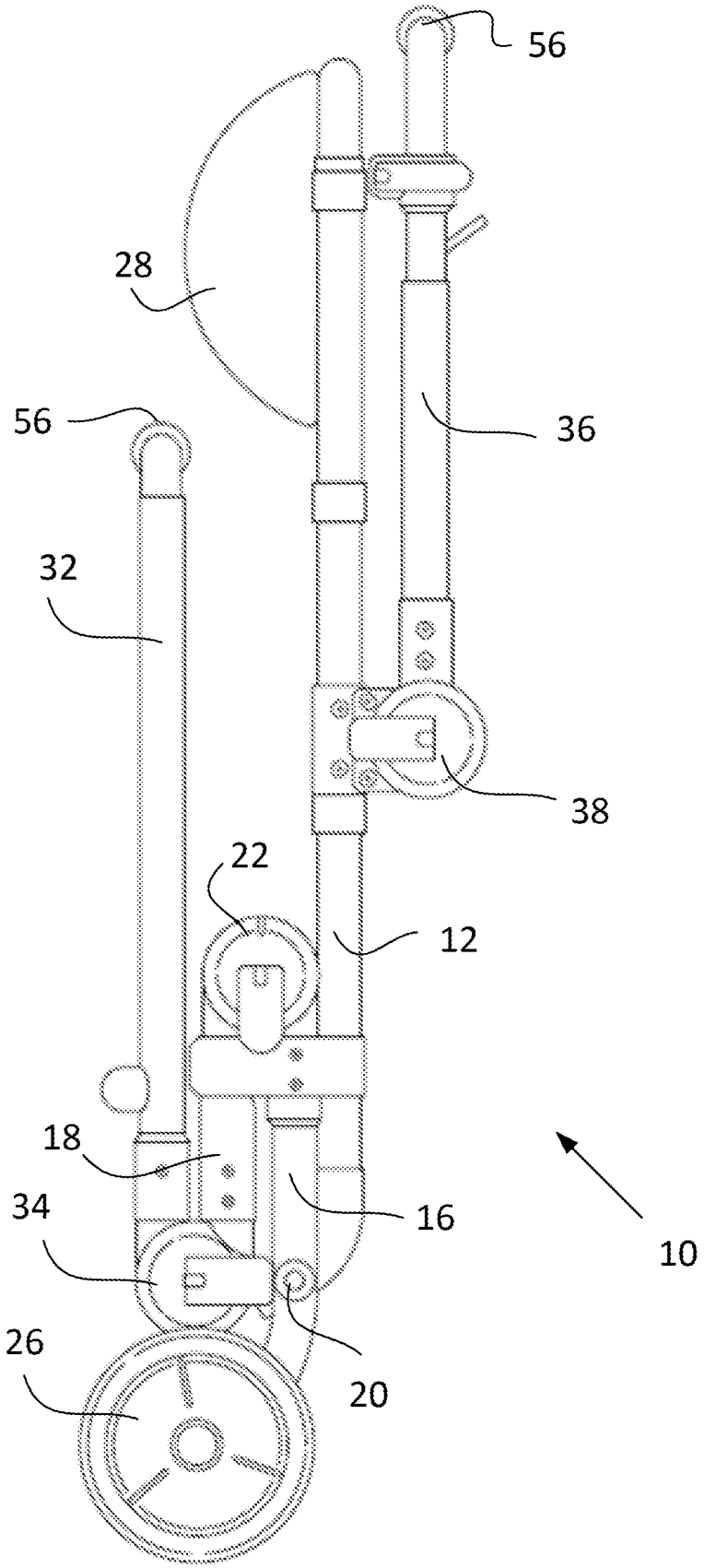
FIG. 5 is a side view of a packable chair in a travel configuration according to an embodiment of the present disclosure.
Figure 6:
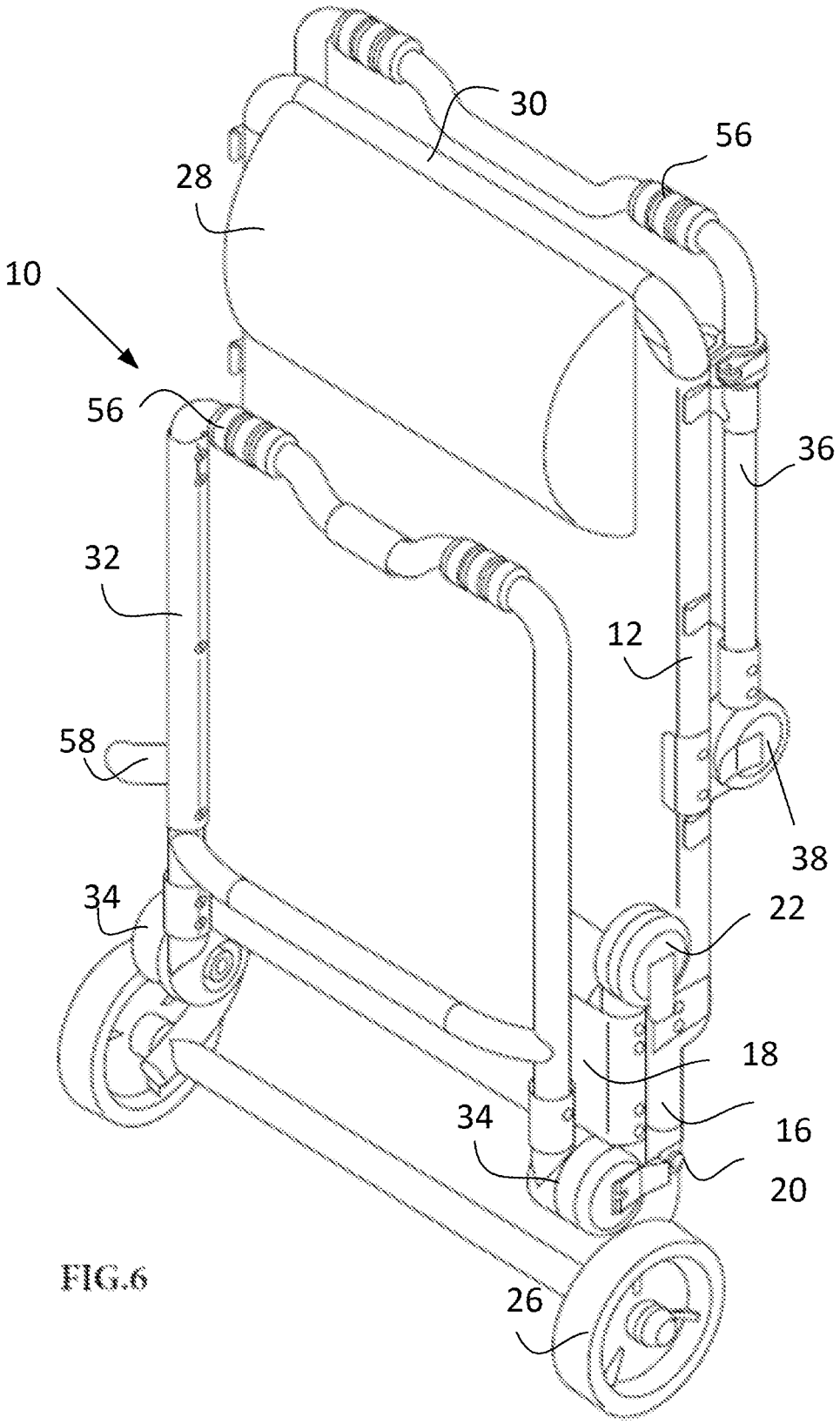
FIG. 6 is a perspective view of a packable chair in the travel configuration shown in FIG. 5.

Referring now to FIGS. 5 and 6, a perspective view and a side view of the chair 10 in a transport configuration are provided, respectively. In the depicted embodiment, the seat portion 14 contains a second seat hinge 22 separating a first seat portion 16 from a second seat portion 18. The back portion 12 and first seat portion 16 are positioned approximately parallel to each other such that the head rest 28 is closer to the second seat hinge 22 than the hinge foot 24 of the first seat portion 16. The second seat portion 18 extends from the second seat hinge 22 approximately parallel to the back portion 12 and the first seat portion 16 away from the head rest 28. The leg rest portion 32 is connected to the second seat portion 18 by the leg rest hinge 34 and is approximately parallel to the back portion 12 and extends towards the head rest 28. The kick stand 36 is attached to the back portion 12 by the kick stand hinge 38 and is positioned approximately parallel to the back portion 12.

As shown, the leg rest 32 and kick stand 36 are shorter than the back portion 12 when the leg rest 32 and kick stand 36 are fully retracted. In some embodiments, the leg rest portion 32 is telescopically extendable such that it can be longer than the back portion 12 when fully extended.

Referring now to FIG. 7, a perspective view of the packable chair 10 in a storage configuration is provided. In this configuration, the leg rest portion 32, second seat portion 18, back portion 12, and head rest 28 are secured to each other such that an internal volume 44 is created. This internal volume can be used to store a user's belongings, such as, but not limited to, towels, coolers, bags, containers, or toys. As depicted, the back portion 12 and first seat portion 16 are approximately parallel to each other. The second seat portion 18 is attached to the first seat portion 16 by a second seat hinge 22 at an approximately 90-degree angle such that the second seat portion 18 extends away from the back portion 12. The leg rest 32 is attached to the second seat portion 18 at an approximately right angle by the leg rest hinge 34 and extends towards the head rest 28. The head rest 28 is positioned such that it extends towards the distal end of the leg rest 32, creating an approximately right angle with the back portion 12. The kick stand 36 is positioned approximately parallel to the back portion 12 and is shown in a fully retracted state. In the depicted embodiment, shoulder straps 40 are connected to the kick stand 36 and the back portion 12. A user can then wear the chair 10 as a backpack for convenient transportation. As shown the shoulder straps 40 can clip to a cross bar of the kick stand 36. In alternative embodiments, the shoulder straps 40 can be sewn to the kick stand 36 and be attachable to the back portion 12. Alternatively, the shoulder straps 40 may be selectively attachable to both the back portion 12 and the kick stand 36.

In addition to being worn as a backpack, the chair 10 can be placed on the ground and rolled on its wheels 26 when the user holds handle 56. Handles are placed on both the distal end of the kickstand 36 and the end of the leg rest 32. These allow the user to roll the chair when in both the chair configuration and in the storage configuration. In some embodiments, the kickstand 36 is telescopic and can be extended beyond the back portion 12 to provide a longer handle in the storage configuration.

The inner surfaces of the back portion 12, the seat portion 14, the head rest portion 28, and the leg rest 32 define an enclosed volume 44 with a rectangular prism shape. Optionally, a plurality of containers can be stacked and positioned in the enclosed volume 44 for transportation as the user wears the chair 10 as a backpack.

Additional features are contemplated to help secure contents within the enclosed volume 44. For instance, straps 58 can extend from the sides of the seat and/or back portions 12, 14 to define the sides of the enclosed volume 44 and retain the contents within the volume. In some embodiments, a lashing or portion of fabric can be attached to one of the portions 12, 14, 28, and 32 in the chair configuration to support a user, but then be reconfigured to span two or more portions in the storage configuration to define the sides of the volume 44. As shown in FIG. 7, fabric panels 60 are unrolled and span the gap between the back portion and the leg rest portion to close the sides of the enclosed volume 44. In one embodiment, a plurality of eyelets extend up and down the sides of the back portion 12 and leg rest 32. Thus, once in the storage configuration, a string or wire can extend through the eyelets to close the open sides of the enclosed volume 44.

The description of the present disclosure has been presented for purposes of illustration and description but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. A packable chair transformable by a user between a first configuration and a second configuration, comprising:

a seat portion having a first seat section and a second seat section, wherein said second seat section is rotatably hinged to said first seat section;

a back portion connected to said first seat section, wherein a length of said first seat section is less than a length of said back portion;

a leg rest portion connected to a distal end of said second seat section such that said leg rest portion is rotatable relative to said second seat section;

a kickstand connected to said back portion and positioned proximate to an outer surface of said back portion such that said kickstand is rotatable relative to said back portion to change an orientation of said back portion relative to a ground surface, wherein said kickstand comprises at least one strap for the user to carry said packable chair;

wherein, in said first configuration, said leg rest portion is folded upwards such that said back portion, said second seat section, and said leg rest portion form an enclosed volume capable of holding contents, and said second seat section is substantially perpendicular to said first seat section; and wherein, in said second configuration, said kickstand portion forms a nonzero angle with said back portion.

2. The packable chair of claim 1, wherein said at least one strap is two adjustable straps oriented vertically such that the user can wear said straps and said packable chair as a backpack.

3. The packable chair of claim 1, further comprising a head rest portion connected to a distal end of said back portion such that said head rest portion is rotatable relative to said back portion, wherein a length of said head rest portion is substantially the same as a length of said second seat section.

4. The packable chair of claim 3, wherein in said first configuration, said head rest is connected to a distal end of said leg rest portion to provide a top surface of the enclosed volume, and wherein said enclosed volume has a substantially rectangular prism shape.

5. The packable chair of claim 1, wherein said back portion and said first seat section are connected to each other with a seat hinge, and a foot extends outward from said seat hinge to support said packable chair on the ground surface in said second configuration.

6. The packable chair of claim 1, wherein said back portion and said kickstand are connected to each other via a kickstand hinge that is selectively positioned along said back portion.

7. The packable chair of claim 1, wherein said leg rest portion is approximately the length of said back portion minus a length of either said first seat section or said second seat section.

8. The packable chair of claim 1, wherein the chair is operable to form a third configuration in which said leg rest portion, said first seat section, said second seat section, and said back portion are positioned substantially planar to each other.

9. The packable chair of claim 1, further comprising selectively securable fabric spanning said leg rest portion, said second seat section, and said back portion; said fabric configurable to form a bottom and sidewalls of the enclosed volume.

10. A packable chair, comprising:

a back portion;

a head rest connected to a distal end of said back portion;

a first seat section of a seat portion connected to a proximal end of said back portion by a first seat hinge;

a second seat hinge connected to a distal end of said first seat section;

a second seat section of said seat portion connected to said second seat hinge;

a leg rest hinge connected to a distal end of said second seat section;

a leg rest portion connected to a distal end of said leg rest hinge, said leg rest portion having a length that is approximately equal to a length of said back portion less a length of said first seat section or said second seat section;

a kick stand extending from a kick stand hinge positioned on said back portion;

wherein the chair is transformable between a first configuration and a second configuration;

wherein in said first configuration, said back portion, said second seat section, said leg rest portion, and said head rest portion cooperate to form a substantially rectangular volume, said first seat section is substantially parallel to said back portion, and said second seat section is substantially perpendicular to said first seat section; and wherein in said second configuration, said first seat section and said second seat section are approximately planar with respect to each other, and said back portion and said kick stand form a non-zero angle.

11. The packable chair of claim 10, wherein said back portion, said second seat section, said leg rest portion, and said head rest cooperate to form an approximately rectangular prism in a third configuration.

12. The packable chair of claim 11, wherein in said third configuration, said kick stand, said back portion, said first seat section, said second seat section, and said leg rest portion are oriented parallel with each other and a strap is connected to said back portion and said leg rest portion.

13. The packable chair of claim 10, further comprising straps that are selectively securable to said back portion and said kickstand to form a backpack when in said first configuration.

14. The packable chair of claim 10, further comprising a wheel positioned on a distal end of said first seat hinge, and wherein said kick stand is selectively telescopic and contains a handle at a distal end of said kick stand.

15. The packable chair of claim 10, further comprising at least one sleeve that fits around said leg rest portion.

16. The packable chair of claim 10, further comprising a securing feature on said head rest such that said head rest can be secured to a distal end of said leg rest portion.

17. The packable chair of claim 10, further comprising a selectively securable panel that can be attached to said back portion and said leg rest portion when said chair is in said first configuration, wherein said second seat hinge and said leg rest hinge are selectively locking hinges.

18. A packable chair transformable by a user between a first configuration and a second configuration, comprising:

a seat portion, said seat portion comprising at least one seat member forming at least one side of said seat portion, wherein said seat portion includes a first length of seat member and a second length of seat member separated by a bend in said at least one seat member, and wherein said first length of seat member is at a first nonzero angle relative to said second length of seat member via said bend;

a back portion connected to said seat portion at a first location on said at least one seat member via a first hinge such that said back portion is rotatable relative to said seat portion, said back portion comprising at least one back member forming at least one side of said back portion;

a leg portion connected to said seat portion at a second location on said at least one seat member via a second hinge such that said leg portion is rotatable relative to said seat portion, said leg portion comprising at least one leg member forming at least one side of said leg portion; and a kickstand connected to said at least one back member of said back portion via a third hinge such that said kickstand is rotatable relative to said back portion to change an orientation of said back portion relative to a ground surface, wherein, in said first configuration, said leg portion, at least said first length of seat member of said seat portion, at least a section of said kickstand, and at least a section of said back portion are positioned substantially planar to each other, and wherein, in said second configuration, said leg portion forms a second nonzero angle with said seat portion and said kickstand portion forms a third nonzero angle with said back portion, said leg portion is operable as a first support for said packable chair against the ground surface, and said kickstand is operable as a second support for said packable chair against the ground surface.

19. The packable chair of claim 18, wherein at least one of:

said seat portion comprises a first material couplable to said at least one seat member and that is operable as a first surface for said seat portion;

said back portion comprises a second material couplable to said at least one back member and that is operable as a second surface for said back portion; and said leg portion comprises a third material couplable to said at least one leg member and that is operable as a third surface for said leg portion.

20. The packable chair of claim 18, wherein, in said second configuration, said second length of seat member is proximate to the ground surface.

* * * * *